US011095036B1

(12) United States Patent
Lambert

(10) Patent No.: US 11,095,036 B1
(45) Date of Patent: Aug. 17, 2021

(54) COUPLED-SLOT AIRFOIL ANTENNA

(71) Applicant: Ball Aerospace & Technologies Corp., Boulder, CO (US)

(72) Inventor: Jeremy R. Lambert, Arvada, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 16/831,073

(22) Filed: Mar. 26, 2020

Related U.S. Application Data

(60) Provisional application No. 62/826,391, filed on Mar. 29, 2019.

(51) Int. Cl.
*H01Q 13/18* (2006.01)
*H01Q 1/28* (2006.01)

(52) U.S. Cl.
CPC ..... *H01Q 13/18* (2013.01); *H01Q 1/28* (2013.01)

(58) Field of Classification Search
CPC ..... H01Q 13/18; H01Q 13/28
USPC ..... 343/708
See application file for complete search history.

(56) References Cited

U.S. PATENT DOCUMENTS 6,943,735 B1 * 9/2005 Cadotte, Jr. ..... H01Q 1/38 343/700 MS
8,629,813 B2 * 1/2014 Milosavljevic ..... H01Q 1/243 343/852
10,826,187 B1 * 11/2020 Godard ..... H01Q 5/50
2004/0004576 A1 * 1/2004 Anderson ..... H01Q 21/064 343/770
2007/0057859 A1 * 3/2007 Kitchener ..... H01Q 13/18 343/770
2011/0012808 A1 * 1/2011 Tatarnikov ..... H01Q 19/10 343/848
2015/0340756 A1 * 11/2015 Huang ..... H01Q 1/243 343/702
2018/0287248 A1 * 10/2018 Han ..... H01Q 13/10
2020/0220273 A1 * 7/2020 Ahmadloo ..... H01Q 21/0043
2020/0259251 A1 * 8/2020 Seo ..... H01Q 9/0407
2020/0287291 A1 * 9/2020 Yang ..... H01Q 21/062

* cited by examiner

*Primary Examiner* — Lam T Mai
(74) *Attorney, Agent, or Firm* — Sheridan Ross P.C.

(57) ABSTRACT

Antennas for radiating radio frequency energy that are integrated into a structure are provided. In particular, one or more nonconductive slots are formed in one or more convex layers or surfaces of a structure. Moreover, each nonconductive slot can be associated with one or more feeds. In at least some embodiments, the structure is an airfoil with a first convex surface joined to a second convex surface along an edge, and the at least one nonconductive slot extends from a point in the first surface or a layer of the structure including the first surface across the edge to a point in the second surface or a layer of the structure including the second surface.

20 Claims, 8 Drawing Sheets

COUPLED-SLOT AIRFOIL ANTENNA

CROSS REFERENCE TO RELATED APPLICATION

The present application claims the benefit of U.S. Provisional Application Ser. No. 62/826,391, filed Mar. 29, 2019, the entire disclosure of which is hereby incorporated herein by reference in its entirety.

FIELD

Systems and methods providing an antenna that produces endfire patterns and that can be integrated with an airfoil or other structure are disclosed.

BACKGROUND

Radio frequency (RF) signals are commonly used for communications and surveillance purposes. The antenna structure used for the transmission and reception of RF signals as part of a radio frequency system must be designed to work efficiently at the operating frequencies of the system. Accordingly, in designing antenna structures, it is desirable to provide appropriate gain, bandwidth, beamwidth, sidelobe level, radiation efficiency, aperture efficiency, and other electrical characteristics. It is also desirable for such structures to be lightweight, simple in design, inexpensive, and unobtrusive. It is also sometimes desirable to hide the antenna structure so that its presence is not readily apparent for aesthetic, functional, and/or security purposes. Accordingly, it is desirable that an antenna be physically small in volume and not protrude on the external side of a mounting surface while yet still exhibiting all the requisite electrical characteristics.

The installation of antennas and antenna arrays in volume constrained platforms has been a consistent and challenging problem for both commercial and military organizations. Applications requiring the use of conformal antennas (confined to the surface of an associated platform) are particularly demanding. Many attempts at solving this problem have been made with some success principally in the area of single antenna apertures. However, many antenna structures have continued to suffer from limited operational bandwidths, and large volume requirements. In addition, there has been little improvement in the development of antenna elements that can be used both singularly and in arrays for these difficult situations. Moreover, previous systems have often incorporated rigid structures, which are prone to breaking when placed in or on structures that undergo flexing during use.

In addition to needing to comply with physical space limitations, antennas are increasingly required to provide support over a wide range of frequencies. However, providing such broadband performance is challenging, particularly where space is limited. Moreover, in at least some antenna configurations there is a trade between the size of the antenna and the available bandwidth.

SUMMARY

Embodiments of the present disclosure are directed to solving these and other problems and disadvantages of other antenna designs. An antenna in accordance with embodiments of the present disclosure includes a nonconductive slot formed in a conductive skin, layer, or surface. The conductive skin can have a first convex outer surface. In accordance with at least some embodiments of the present disclosure the conductive skin has first and second convex outer surfaces that are joined to one another along an edge, and the nonconductive slot can start at a first point in or adjacent to the first convex outer surface, and can extend across to the edge to a second point in or adjacent to the second convex outer surface. A first feed can be located at a first feed point along a portion of the nonconductive slot located in or adjacent to the first outer surface, and a second feed can be located at a second feed point along a portion of the nonconductive slot located in or adjacent to the second outer surface.

An antenna in accordance with embodiments of the present disclosure can be realized as a single slot, or a plurality of slots, formed at intervals within the length of a conductive material forming all or portions of a structure. The slots form radiating apertures. In accordance with at least some embodiments, the structure is an aerodynamic structure, the skin includes first and second portions forming first and second surfaces of the aerodynamic structure, and the slots extend across an airfoil edge along which the first and second skin or surface portions intersect. Moreover, the curvilinear structure of the airfoil presents an excellent geometric shape for making a wideband slot-fed antenna aperture. The slot excites currents across the curved surface. These currents that give rise to radiated electromagnetic fields that are well matched across a very wide frequency range, have good front-to-back ratios, i.e., most radiation goes in the forward direction, and are low loss, leading to very high gain and power handling performance. The disclosed systems and methods can be easily integrated into an existing airfoil edge, with minimal changes or impact to the aerodynamics or structural integrity of the airfoil structure.

The antenna aperture slots can be varied in length. Moreover, aperture slots of different lengths can be interleaved with one another, to create a very wideband antenna response that utilizes the full length of the airfoil edge. Accordingly, embodiments of the present disclosure are capable of providing long electrical baseline antenna arrays with greater gain and narrower beamwidth than other structures. In accordance with further embodiments of the present disclosure, the antenna structure can be contained entirely within an outer airfoil skin, thus adding little weight to the existing structure and taking on the properties of the skin material. This allows the antenna system to be flexible and robust to wing frame flexures, properties that other designs struggle with. The antenna system is also robust to changes in the airfoil shape and maintains good antenna gain and pattern coverage for a large spectrum of airfoil profiles, e.g., from narrow and pointy to wide and blunt forward edges.

In accordance with further embodiments, an antenna as disclosed herein can include a plurality of nonconductive slots. Moreover, the nonconductive slots can have different lengths. The nonconductive slots of different lengths can be interleaved with one another. A dielectric material, a frequency selective surface (FSS), or other material may be placed in portions or can entirely fill some or all of the nonconductive slots.

Methods in accordance with embodiments of the present disclosure include forming a plurality of nonconductive slots or aperture slots in a conductive skin or a conductive layer of an airfoil or other structure. A feed network is formed on a printed circuit board (PCB), printed wiring board (PWB), or other structure, thereby forming a feed network structure. The feed network structure can be bent or contoured to conform to the contour of the airfoil. The feed network structure can then be bonded or otherwise attached to the airfoil, with feed points formed as part of the feed network structure aligned with the nonconductive slots. A transceiver or other backend electronics can be connected to the feed structure.

Additional features and advantages of the present disclosure will become more readily apparent from the following description, particularly when taken together with the accompanying drawings.

DETAILED DESCRIPTION

Figure 1:
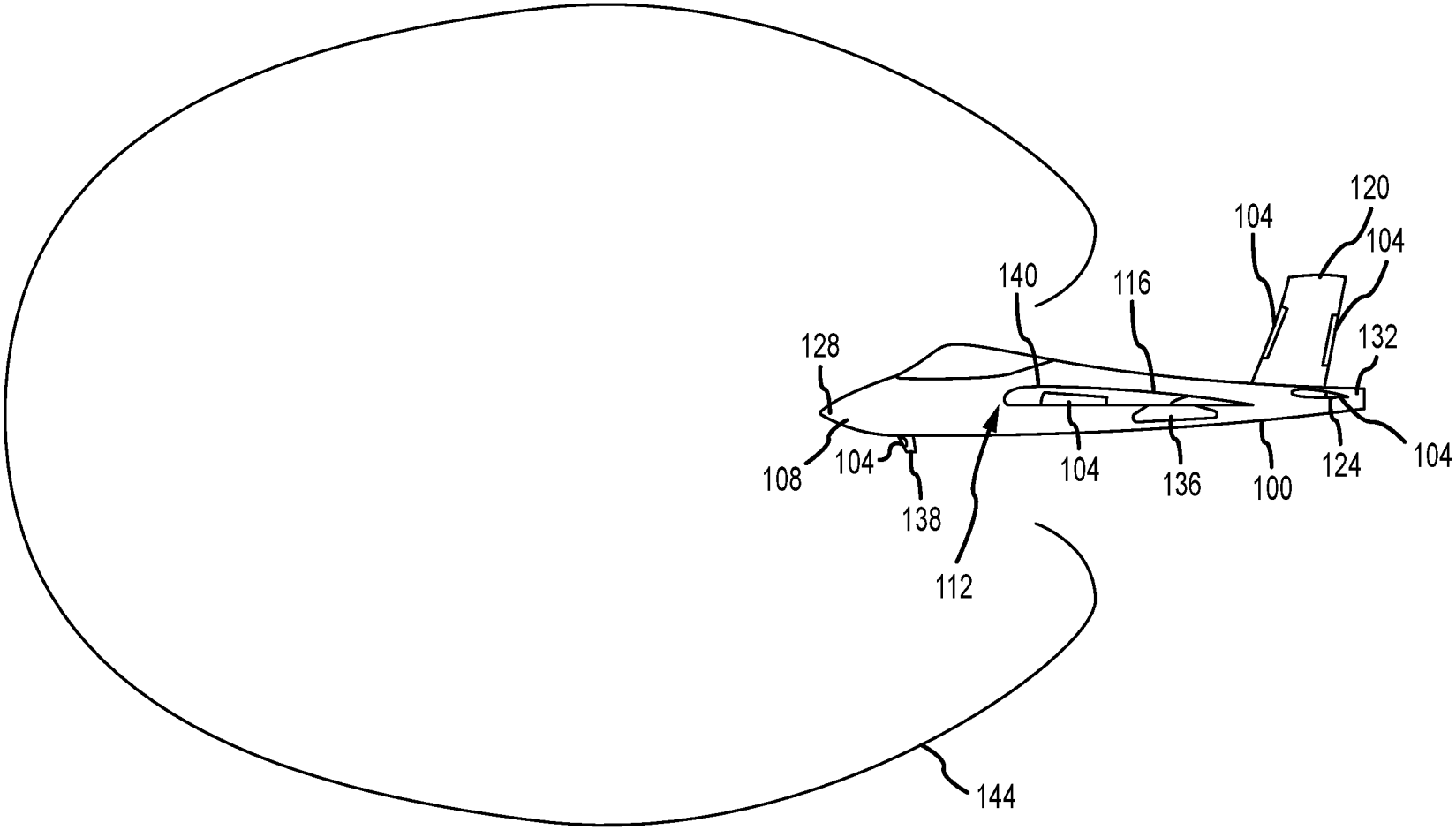
FIG. 1 depicts a platform carrying an antenna system in accordance with embodiments of the present invention, and an example beam pattern produced by the antenna.

FIG. 1 depicts a platform 100 carrying one or more antennas or antenna systems 104 in accordance with embodiments of the present disclosure. In this example, the platform 100 is an aircraft 108 that includes a number of structures 112, such as wings 116, one or more rudders 120, elevators 124 or other airfoils or aerodynamic structures. Still other examples of structures 112 that can be included as part of an aircraft 108 or other platform 100 include but are not limited to a nose cone 128, tail cone 132, nacelle 136, flap, strut, or the like. In accordance with still other embodiments, a platform 100 can include an antenna housing 138 specifically provided for purposes of housing an antenna system 104 as disclosed herein, and optionally other antennas or systems. In any configuration, the shaping of the external surface formed by or over a conductive skin portion 140 of a structure 112 is important to the aerodynamic performance of the aircraft 108. As described herein, an antenna system 104 in accordance with embodiments of the present disclosure can be integrated with various structures 112 without requiring alterations to the surfaces of the structures 112. Moreover, an antenna system 104 in accordance with embodiments of the present disclosure can be integrated with such structures 112 without materially compromising the structural integrity of the structures 112. Although various examples of embodiments of the present disclosure set forth herein discuss incorporating an antenna system 104 in a structure 112 in the form of a wing or other aerodynamic structure, antenna systems 104 as disclosed herein are not so limited. In particular, an antenna system 104 can be incorporated into, for example, space craft, terrestrial vehicles, seagoing vehicles, stationary platforms, or other vehicles or structures.

In various applications, it is a desirable to provide a beam pattern 144 within or over a selected area relative to the antenna system 104. In addition, it is often desirable to provide support for frequencies that extend over a relatively wide bandwidth. As described in greater detail elsewhere herein, an antenna system 104 in accordance with embodiments of the present disclosure can provide desired beam coverages over a wide bandwidth.

FIGS. 2, 3, 4, 5, 6A, and 6B are top plan, end, bottom plan, top perspective, and two cross section views respectively of a portion of an antenna system 104 integrated into a structure 112 in accordance with embodiments of the present disclosure. In this example, the structure 112 is a leading edge 208 portion of a wing 116. However, the basic structure and principles of the antenna system 104 described in this example apply to other structures 112. For example, the antenna system 104 can be integrated into a leading edge or any other edge (e.g. a trailing edge) at or along which convex surfaces of a structure 112 intersect. In general, an antenna system 104 in accordance with embodiments of the present disclosure includes a portion of the conductive surface or skin 140 of the structure 112 with which the antenna system 104 is integrated. The antenna system 104 additionally includes at least one nonconductive slot 204 formed in the conductive skin 140. In accordance with further embodiments of the present disclosure, an antenna system 104 can include a plurality of nonconductive slots 204. Each of the nonconductive slots 204 can extend from an edge 208 of the structure 112 for some distance to a first point 212 on a first surface (e.g. a top surface) 304 of the structure 112 and at a selected distance from the edge 208. In addition, each of the nonconductive slots 204 can extend from the edge 208 of the structure 112 for some distance to a second point 214 on a second surface (e.g. a bottom surface) 308 of the structure 112.

In embodiments in which the antenna system 104 has a plurality of nonconductive slots 204, those nonconductive slots 204 can have different lengths, where the length is generally measured from the edge 208 of the structure 112 to the first point 212 or the second point 214. For instance, a first plurality of nonconductive slots 204*a* may extend between the edge 208 and the first point 212*a* such that they have a first length in a portion formed in the first surface 304, and between the edge and the second point 214*a* such that they have the first length in a portion formed in the second surface 308. Similarly, a second plurality of nonconductive slots 204*b* may extend between the edge 208 and the first point 212*b* such that they have a second length in a portion formed in the first surface 304, and between the edge 208 and second point 214*b* such that they have the second length in a portion formed in the second surface 308. In accordance with the least some embodiments of the present disclosure, and as depicted in FIGS. 2, 3, 4 and 5, the nonconductive slots 204*a* and 204*b* can be interleaved with one another. In accordance with still other embodiments of the present disclosure, a spacing between adjacent nonconductive slots 204 in either of the pluralities of nonconductive slots 204*a* or 204*b* can be proportional to their length. As can be appreciated by one of skill in the art after consideration of the present disclosure, the length of the nonconductive slots 204 generally correspond to the frequency or range of frequencies at or over which the slots 204 are operational. For example, a first set of slots 204*a* may have a length that is compatible with a first frequency range, and the second set of slots 204*b* may be compatible with a second frequency range. Moreover, the first and second frequency ranges may overlap, may be adjacent, or may be spaced apart from one another. In addition, although various example configurations including a first set of nonconductive slots 204*a* having a first length and a second set of nonconductive slots 204*b* having a second length are discussed herein, embodiments of the present disclosure are not so limited. In particular, any number of nonconductive slot 204 sets can be included in an antenna system 104 as disclosed herein. Moreover, any number of nonconductive slots 204 can be included in a set of nonconductive slots 204.

As can be appreciated by one of skill in the art after consideration of the present disclosure, a structure 112 can include opposed conductive skin portions 140 that are interfaced or joined along the edge 208 of the structure 112. For instance, where the structure 112 is a wing 116, the conductive skin portions 140 include a first (e.g. a top) surface 304 and a second (e.g. a bottom) surface 308 (see, e.g., FIGS. 3, 5, 6A, and 6B). In accordance with at least some embodiments of the present disclosure, each nonconductive slot 204 can extend across the edge 208, into the first 304 and second 308 surfaces. Moreover, the length of a first portion 312 of a nonconductive slot 204 (i.e. the portion of the nonconductive slot 204 formed in the first surface 304) may be the same as or different than the length of the second portion 316 of the nonconductive slot 204 (i.e. the portion of the nonconductive slot 204 formed in the second surface 308). As can further be appreciated by one of skill in the art after consideration of the present disclosure, the first 304 and second 308 surfaces include at least portions that face away from one another. In addition, the first surface 304, the second surface 308, or both the first 304 and second 308 surfaces, can be in the form of at least partially convex surfaces. In accordance with still other embodiments of the present disclosure, the skin 140 can have a continuous convex surface, and the edge 308 dividing between the first 304 and second 308 surfaces can be a line that is equidistant from the end points of the slots 204 or that is equidistant between the feed points associated with the slots 204. Moreover, one or both surfaces 304 and 308 can be flat. In accordance with further embodiments of the present disclosure, a nonconductive slot 204 can be formed only in one of the first 304 or second 308 surfaces.

Figure 2:
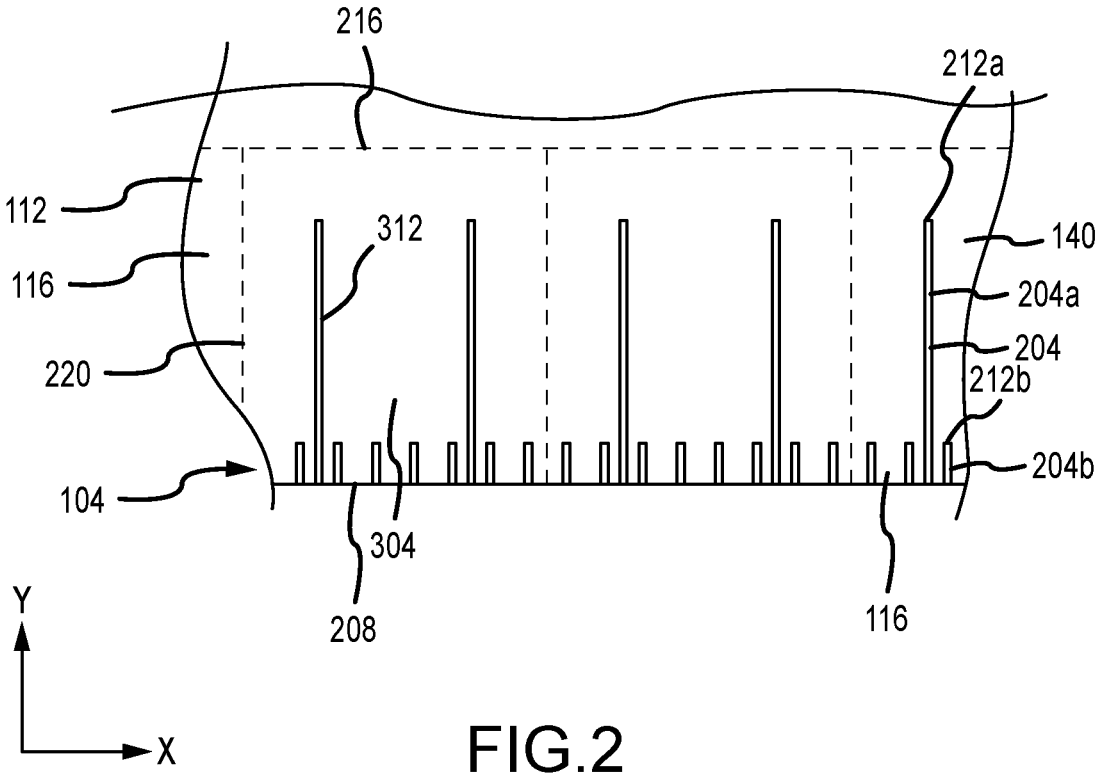
FIG. 2 is a top plan view of an antenna system integrated into an aerodynamic structure in accordance with embodiments of the present disclosure.
Figure 4:
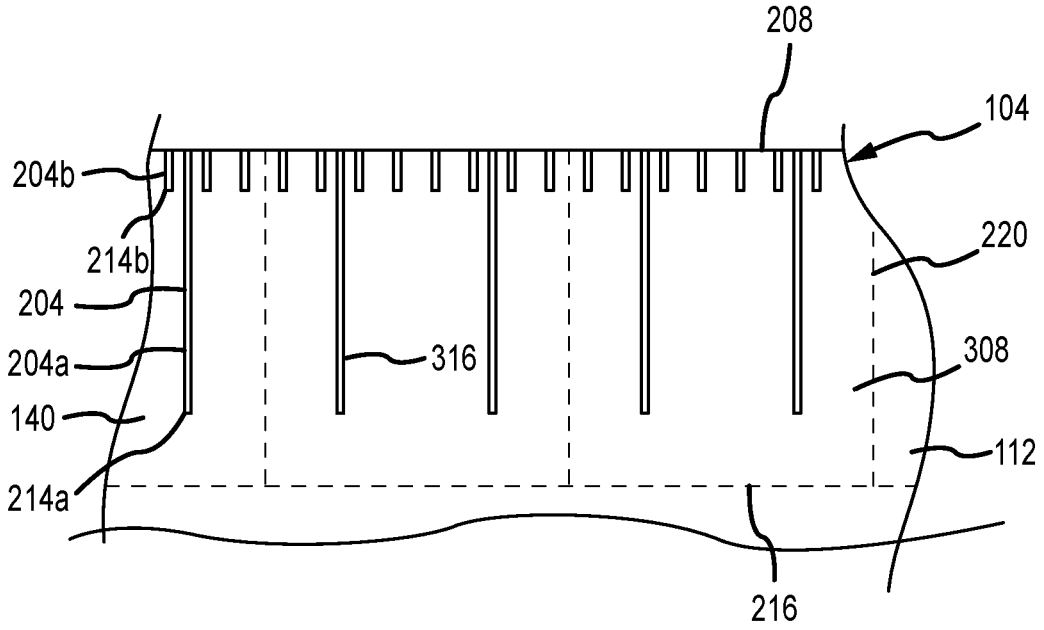
FIG. 4 is a bottom plan view of an antenna system integrated into an aerodynamic structure in accordance with embodiments of the present disclosure.
Figure 5:
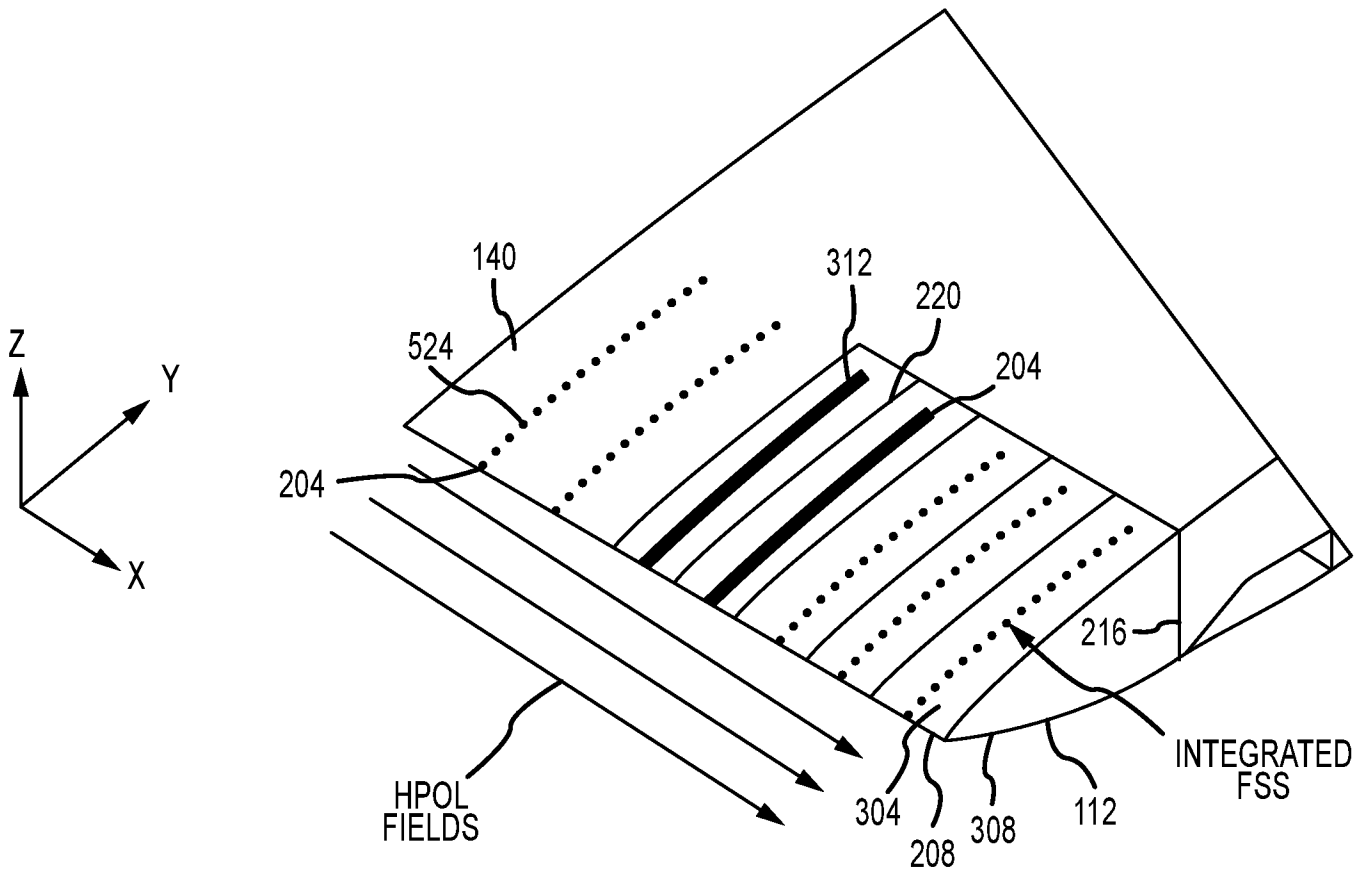
FIG. 5 is a top perspective view of an antenna system integrated into an aerodynamic structure in accordance with embodiments of the present disclosure.

With particular reference to FIGS. 2, 4, and 5, it can be seen that an antenna system 104 in accordance with embodiments of the present disclosure can be integrated with various structural features or elements of a structure 112. These structures can include a spar 216 that extends along the length of the structure 112, and one or more ribs 220 that extend between at least the edge 208 and the spar 216. The structural elements 216 and 220 can be formed from conductive materials. For example, the structural elements 216 and 220 can be formed from metal. In accordance with still other embodiments, some or all of the structural elements 216 and 220 can be electrically integrated with the antenna system 104. For example, the spar 216 can form a ground member that electrically connects the first 304 and second 308 surfaces of the structure 112. Moreover, the spar 216 and pairs of ribs 220 can define volumes that contain some number of nonconductive slots 204.

Figure 3:
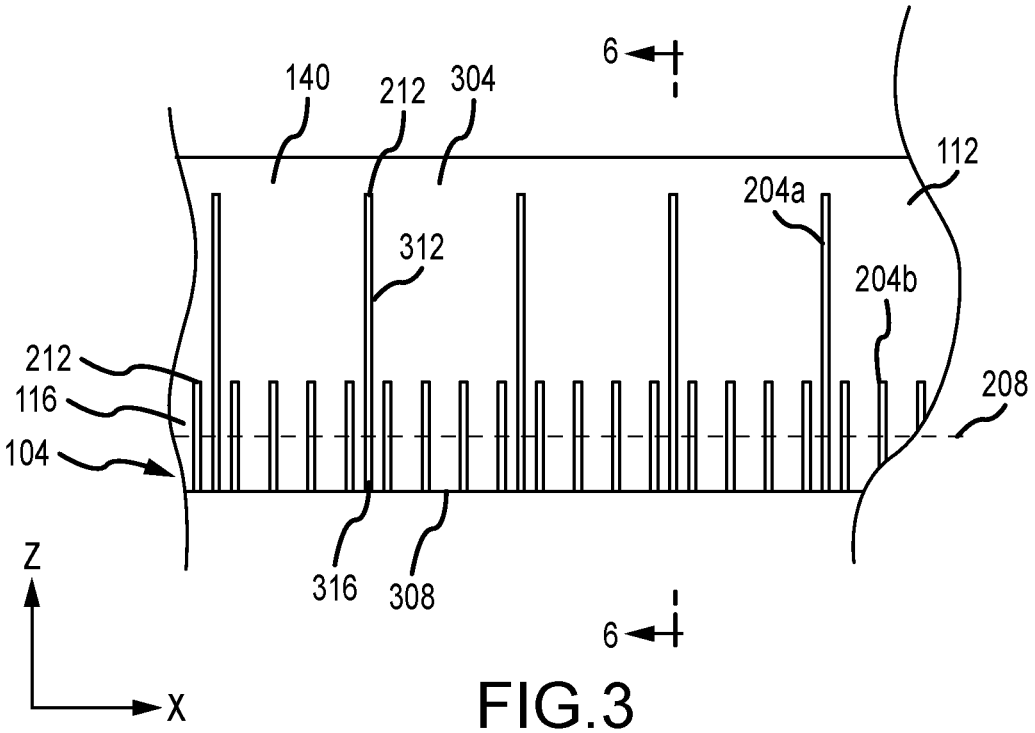
FIG. 3 is an end view of an antenna system integrated into an aerodynamic structure in accordance with embodiments of the present disclosure.
Figure 6A:
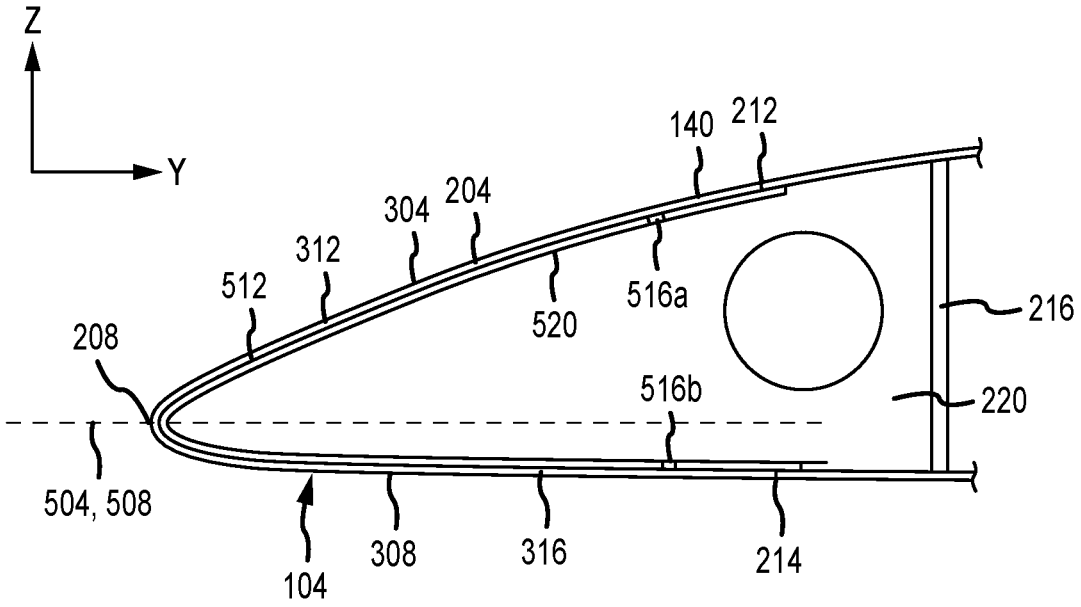
FIG. 6A is a cross section of a portion of an antenna system integrated into an aerodynamic structure in accordance with embodiments of the present disclosure.

FIG. 6A is a cross section taken along section line 6-6 in FIG. 3 of a portion of an antenna system 104 integrated into a structure 112 in accordance with embodiments of the present disclosure. In this example, the conductive skin portion 140 of the structure 112, here a wing 116, includes a first surface 304 portion on a top or a first side of a first plane 504 that extends through the edge 208 of the structure 112, and that is generally parallel to a horizontal axis of 508 the structure 112, or some other selected reference line, and a second surface 308 portion on a second side of the first plane 504. At least a portion of the first surface 304 and at least a portion of the second surface 308 are convex on an exterior surface side of the surfaces 304 and 308. In addition, the structure 112 in this example is formed from a conductive material or sheet. For example, the conductive skin portion 140 is coincident with an exterior surface of the structure 112, and can be formed from aluminum, some other metal, or some other electrically conductive material. Accordingly, the nonconductive slot 204 extends through the conductive skin portion 140. The first portion 312 of the nonconductive slot 204 extends from the edge 208 to a first point 212, and the second portion 316 of the nonconductive slot 204 extends from the edge 208 to a second point 214. In addition, in this example the length of the first portion 312 of the nonconductive slot 204 along the first surface 304 is the same as a length of the second portion 316 of the nonconductive slot 204 along the second surface 308, where the length is measured from the edge 208 formed by the intersection of the first 304 and second 308 surfaces to the respective termination point 212 or 214. The nonconductive slot 204 may contain a filler material 512. The filler material 512 can include a dielectric. Alternatively or in addition, the filler material 512 can include a frequency selective surface (FSS) 524. As yet another alternative, the nonconductive slot 204 may comprise a void.

Each nonconductive slot 204 can be associated with one or more feed points 516. For example, a first feed point 516*a* can be associated with the first portion 312 of the nonconductive slot 204, and a second feed point 516*b* can be associated with the second portion 316 of the nonconductive slot 204. Each feed point 516 can be connected to or can be formed integrally with feed lines formed as part of a circuit board structure 520, hereinafter referred to simply as a circuit board. The circuit board 520 may be formed as a printed circuit board (PCB). The circuit board 520 can be configured to conform to an interior surface of the structure 112 in an area including some or all of the nonconductive slot or slots 204 of the antenna system 104.

Figure 6B:
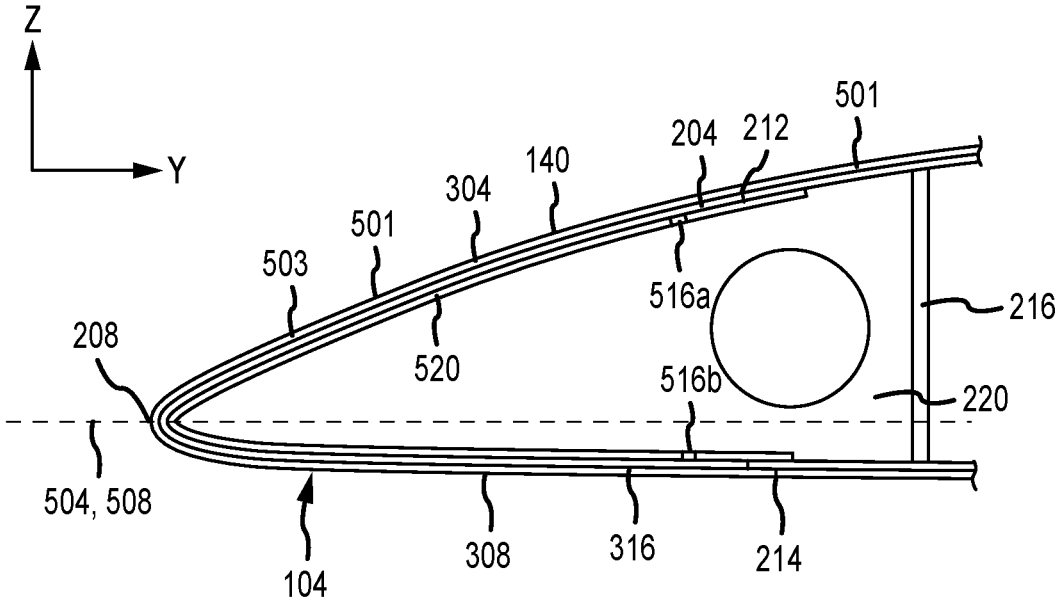
FIG. 6B is a cross section of a portion of an antenna system integrated into an aerodynamic structure in accordance with other embodiments of the present disclosure.

FIG. 6B is a cross section of a portion taken along section line 6-6 in FIG. 3 of a portion of an antenna system 104 integrated into a structure 112 in accordance with further embodiments of the present disclosure. In this example, the structure 112 differs from the prior example in that the conductive skin portion 140 is formed from a composite material having a plurality of layers. Accordingly, an outermost layer 501 may comprise a nonconductive resin impregnated fiber layer or other nonconductive material layer, while a middle or interior layer 503 may comprise or incorporate an electrically conductive material. In this example, the nonconductive slots 204 are formed in the layer 503 incorporating an electrically conductive material. The nonconductive slots 204 may be completely or partially filled with a dielectric material. Alternatively or in addition, the nonconductive slots 204 can contain a frequency selective surface. In accordance with still other embodiments, a frequency selective surface may be provided as part of the outermost layer 501, or as an additional layer, so as to overlay one or more nonconductive slots 204. As can be appreciated by one of skill in the art after consideration of the present disclosure, the spar 216, ribs 220, and other components of the structure 112 can also be formed from composite materials.

Figure 7:
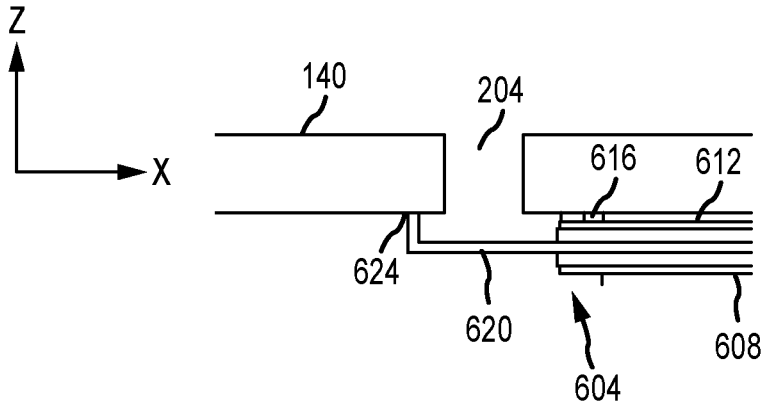
FIG. 7 depicts a feed structure in accordance with embodiments of the present disclosure in cross section.

FIG. 7 depicts a feed structure 604 in accordance with embodiments of the present disclosure in cross section, looking along the length of a nonconductive slot 204. In this example, the feed structure 604 includes a coaxial cable 608 with a shield conductor 612 grounded to the conductive skin portion 140 at a first point 616 on a first side of the nonconductive slot 204, and a center conductor 620 grounded to the conductive skin portion 140 at a second point 624 on a second side of the nonconductive slot 204.

Figure 8:
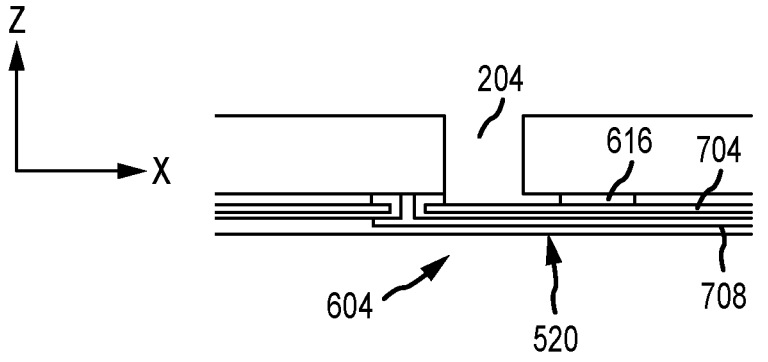
FIG. 8 depicts a feed structure in accordance with other embodiments of the present disclosure in cross section.

FIG. 8 depicts a feed structure 604 in accordance with other embodiments of the present disclosure. In this example, the feed structure 604 is formed from a circuit board 520 having a ground plane or conductor 704 that is electrically connected to the conductive skin portion 140 at a first point 616 on a first side of the nonconductive slot 204, and a feedline 708 that is grounded to the exterior surface 140 at a second point 624 on a second side of the nonconductive slot 204.

Figure 9A:
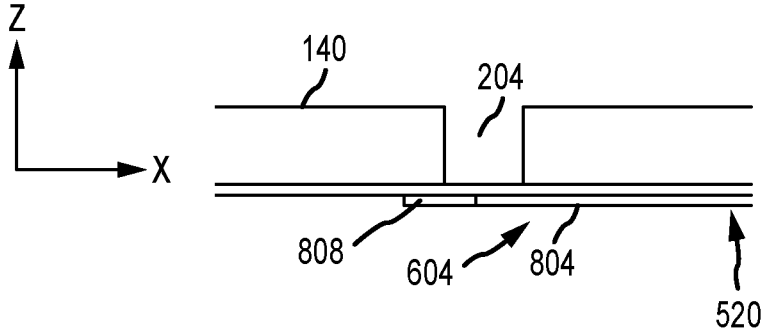
FIG. 9A depicts a feed structure in accordance with other embodiments of the present disclosure in cross section.
Figure 9B:
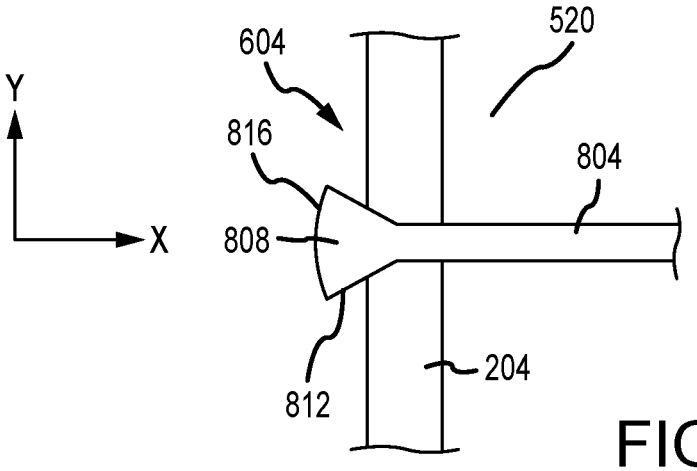
FIG. 9B depicts the feed structure of FIG. 9A in plan view.

FIG. 9A depicts a feed structure 604 in accordance with other embodiments of the present disclosure in cross section, and FIG. 9B depicts the feed structure of FIG. 9A in plan view. In this example, the feed structure 604 is formed from a circuit board 520 having a feed line 804 that extends across the nonconductive slot 204, and that is electrically isolated or suspended relative to the conductive skin portion 140. In addition, the feed line 804 can include a flared portion 808. The flared portion 808 can include side portions 812 that extend away from one another, and that are terminated at a curved end portion 816.

Figure 10:
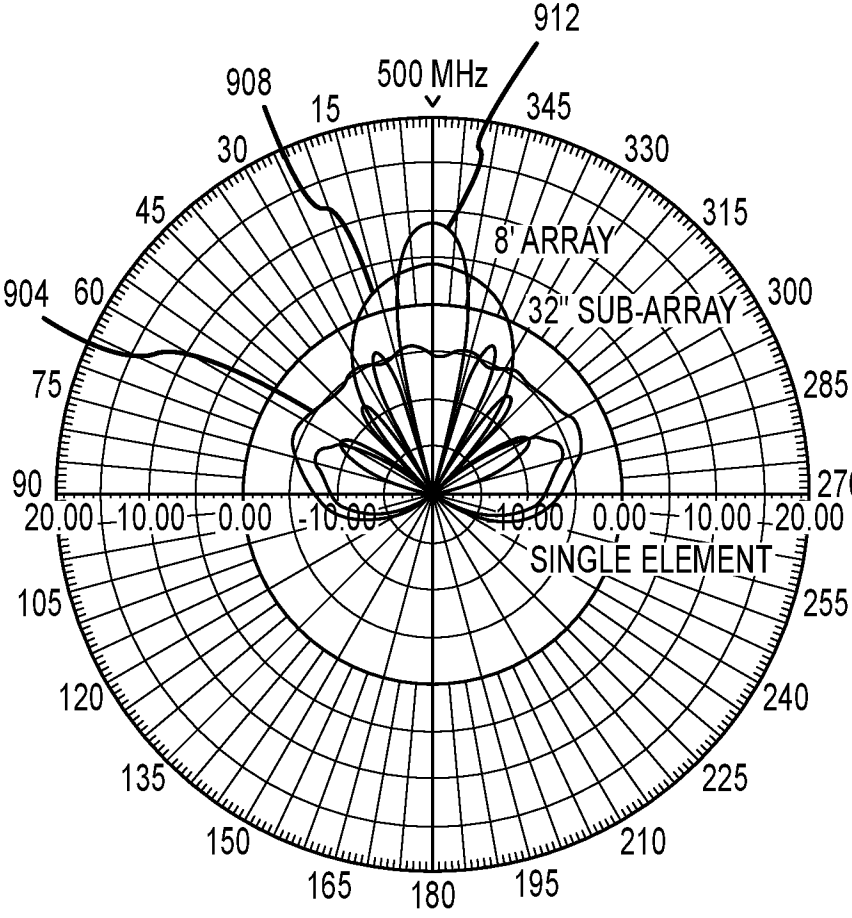
FIG. 10 depicts beam patterns produced by an antenna system in accordance with embodiments of the present disclosure.

FIG. 10 depicts beam patterns produced by an antenna system 104 in accordance with embodiments of the present disclosure. More particularly, several example antenna beam patterns in azimuth are depicted: an antenna beam pattern 904 produced by exciting a single nonconductive slot 204 of an antenna system 104 in accordance with embodiments of the present disclosure; an antenna beam pattern 908 produced by exciting a number of nonconductive slots 204 within a 32 inch sub array of the antenna system 104; and an antenna beam pattern 912 produced by exciting all of the nonconductive slots within an entire 8 foot array of nonconductive slots 204 within the antenna system 104. As can be appreciated by one of skill in the art after consideration of the present disclosure, the nonconductive slot or slots 204 excited in order to produce the example beam patterns can include those slots associated with the frequency of the signal used to produce the pattern, in this example 500 MHz. From the illustrated patterns it can be appreciated that the antenna system 104 can provide wide to narrow forward directional patterns in azimuth, depending on the length of the aperture excited.

Figure 11:
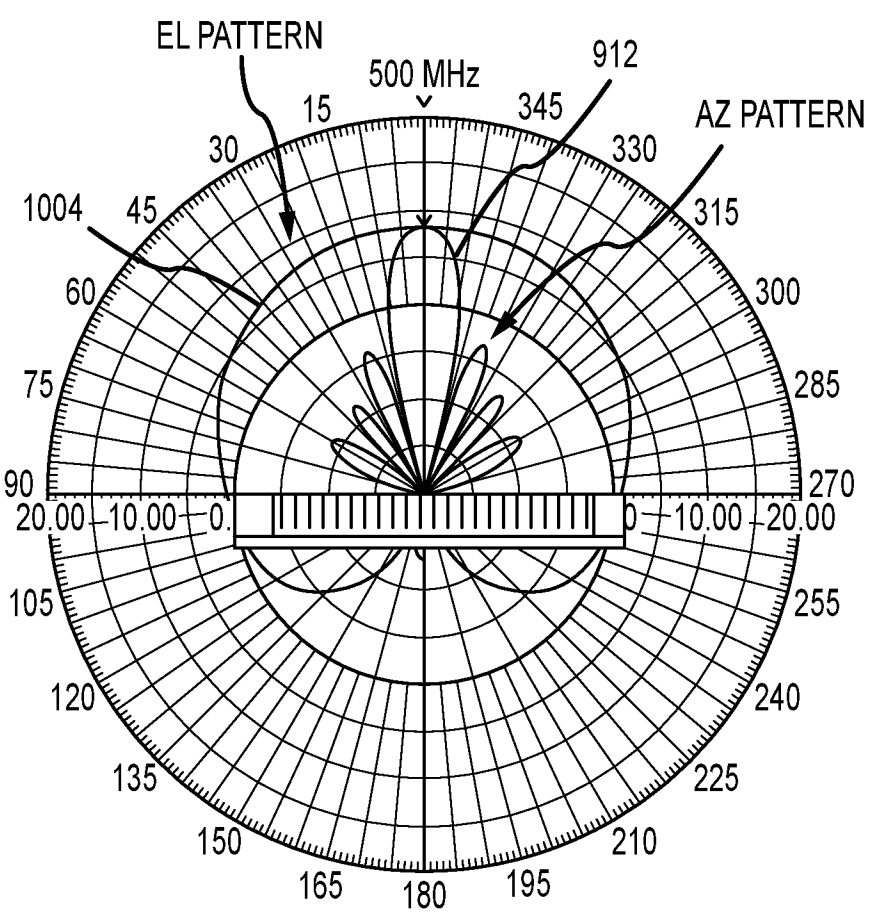
FIG. 11 depicts beam patterns produced by an antenna system in accordance with embodiments of the present disclosure.

FIG. 11 depicts the beam pattern in azimuth 912 overlaid with the beam pattern in elevation 1004 that are produced by exciting the entire array of an example antenna system 104. As is apparent from the figure, embodiments of the present disclosure provide very broad forward directional patterns in elevation and azimuth.

Figure 12:
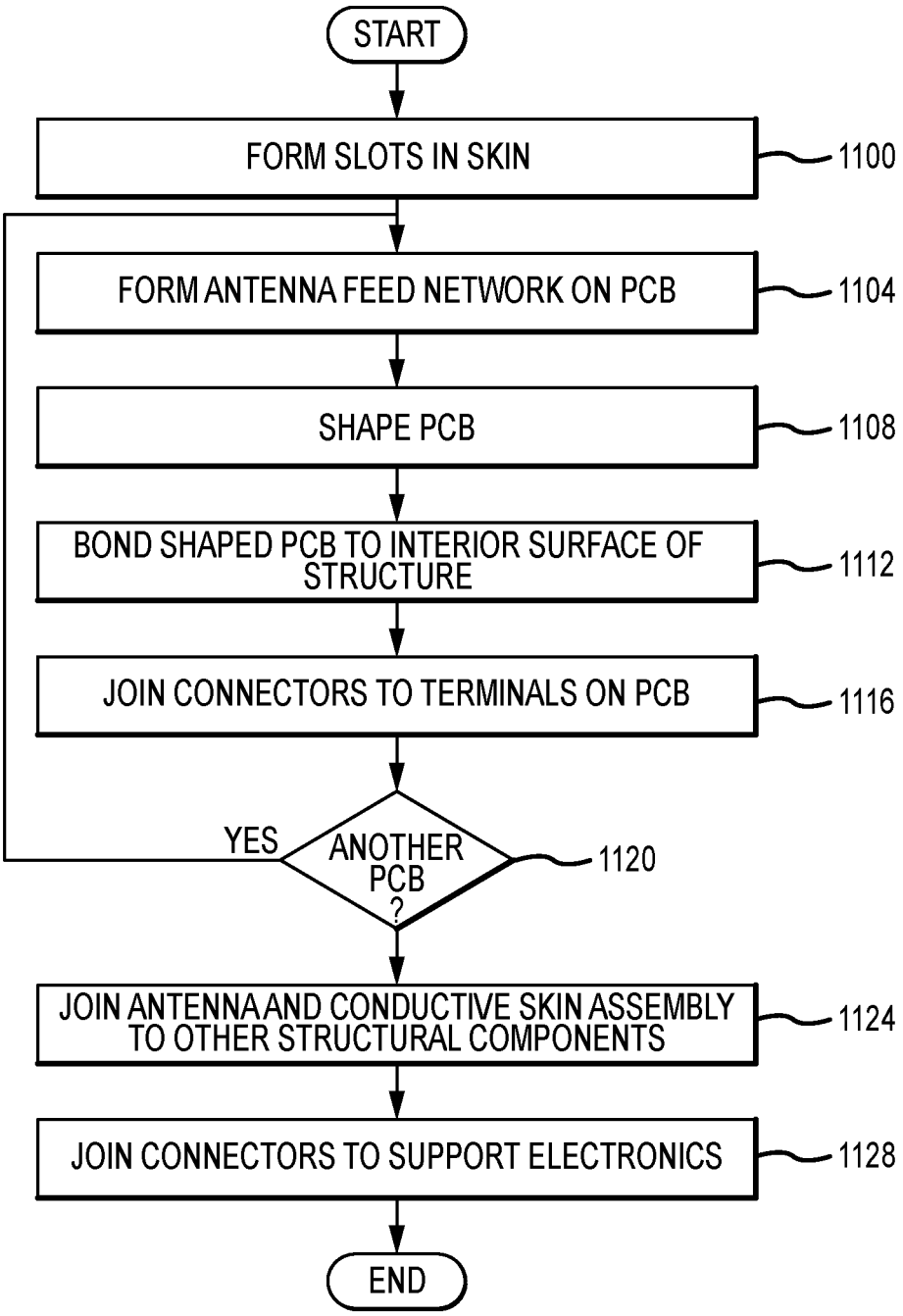
FIG. 12 is a flow chart illustrating aspects of a process for producing an antenna in accordance with embodiments of the present disclosure.

FIG. 12 is a flow chart illustrating aspects of a process for producing an antenna system 204 in accordance with embodiments of the present disclosure. Initially, at step 1100, nonconductive slots 204 are formed in a conductive layer or a conductive skin 140 portion of a structure 112. At step 1104, an antenna feed network is formed on a circuit board 520, such as a printed circuit board (PCB). The antenna feed network can include feed lines signals between a transceiver or other components and feed points 516. In accordance with the least some embodiments of the present disclosure, the feed network can include integrated feed structures 604. The circuit board 520 can then be bent around a fixture, thereby shaping a surface of the circuit board 520 to conform to an interior surface of the conductive skin portion 140 of the structure 112 (step 1108). The shaped circuit board 520 can then be bonded to the interior surface of the aerodynamic structure (1112). As an example, the circuit board 520 can be autoclave bonded to the interior of the structure 112. As can be appreciated by one of skill in the art after consideration of the present disclosure, the circuit board 520 is located relative to the conductive skin portion 140 of the structure 112 such that the feed structures 604 are placed adjacent corresponding nonconductive slots 204. At step 1116, connectors can be soldered or otherwise joined to terminals formed on the circuit board 520, thereby completing an antenna and conductive skin assembly.

In accordance with at least some embodiments of the present disclosure, the antenna feed network can be formed in sections that are each on separate printed circuit boards. For example, each section can be configured to fit between adjacent ribs 220 of the structure 112 and/or adjacent first 304 or second 308 surfaces of the structure 112. In such embodiments, each section of the feed network can be identical. Accordingly, at step 1120, a determination can be made as to whether another circuit board 520 should be formed in connection with creating another antenna and conductive skin assembly. If yes the process can return to step 1104. If no the process can continue to step 1124, and the antenna and conductive skin assembly or assemblies can be joined to other structural components of the structure 112, such as a spar 216 and ribs 220. Next, at step 1128, the connectors can be joined to a transceiver or other support electronics components. The antenna system 104 is then operational, and the process may end.

In accordance with further embodiments of the present disclosure, feed lines, feed structures, and/or other components can be formed integrally as part of a layup of a structure 112 formed as a single integrated composite component.

In an exemplary embodiment, an antenna system 204 can include 24 low band nonconductive slots 204 interleaved with 96 high band nonconductive slots 204. The total length of the antenna system 204 may be about 8 feet. Each nonconductive slot 204 can be associated with two feed structures 604, for a total of 240 connectors.

Embodiments of the present disclosure improve upon legacy leading edge airfoil wing antenna capabilities by significantly increasing the horizontally polarized (HPOL) RF radiated energy performance. A Coupled-Slot Airfoil Antenna (CSAA) as disclosed herein takes a new approach to integrated antenna design, e.g., utilizing the metal boundary conditions of the platform to create a very wideband antenna match that leads to optimal pattern shape and efficiency. Prior art designs have always tried to remove the metal boundary condition in order to make the antenna aperture work, in large part due to the lack of any apparent widespread broadband antenna element that would work with the existing boundary conditions.

Antenna systems as disclosed herein are inherently conformal, as radiating elements are provided as nonconductive slots formed in a conductive surface or layer of a structure. In addition, the antenna systems as disclosed herein do not require the addition of separate, rigid structures. Moreover, an antenna system 104 in accordance with embodiments of the present disclosure can be provided economically, using conventional manufacturing techniques. Embodiments of the present disclosure can be formed as part of the leading edge of a wing or other airfoil, or other structure having one or more convex surfaces.

Embodiments of the present disclosure provide excellent bandwidth and gain characteristics, and can be integrated into structures that form parts of a platform, including but limited to an airplane or other vehicle. In addition, antenna systems in accordance with embodiments of the present disclosure are structurally robust and can operate even in the presence of extreme flexing of the structure. In addition, the materials used to form the antenna can be much less expensive than previous systems. Moreover, embodiments of the present disclosure can utilize low-loss materials that have minimal impact on efficiency or gain, and can be formed using highly simplified fabrication processes as compared to previous antenna designs. The simple configuration and high levels of integration with structures of embodiments can provide significantly better structural integrity. In addition, the configuration of an antenna system in accordance with embodiments of the present disclosure can provide much better antenna efficiency and gain than previous systems configured for conformal operation. In addition, antenna systems 104 in accordance with embodiments of the present disclosure feature a scalable design that accommodates a wide range of antenna array element pitch spacing.

Antenna structures and methods as provided herein improve upon legacy leading edge airfoil wing antenna capabilities by significantly increasing the horizontally polarized (HPOL) RF radiated energy performance while maintaining the integrity of the original structure. The disclosed systems and methods can work with existing airfoil structure and material sets, with no need to cut large holes in the structure. Antenna systems and methods as disclosed herein provide antenna systems that can be integrated into airfoils and that are structurally robust and work with extreme airfoil flexing. The materials used to implement an antenna system 104 as disclosed herein can be much less expensive than alternative systems, and can use low-loss materials that have minimal impact on efficiency or gain. Moreover, the fabrication process is highly simplified as compared to previous systems.

The foregoing description has been presented for purposes of illustration and description. Further, the description is not intended to limit the disclosure to the form disclosed herein. Consequently, variations and modifications commensurate with the above teachings, within the skill or knowledge of the relevant art, are within the scope of the present disclosure. The embodiments described hereinabove are further intended to explain the best mode presently known of practicing the disclosed systems and methods and to enable others skilled in the art to utilize the disclosed systems and methods in such or in other embodiments and with various modifications required by the particular application or use. It is intended that the appended claims be construed to include alternative embodiments to the extent permitted by the prior art.

What is claimed is:

1. An antenna, comprising:

a structure, wherein the structure includes a conductive skin, wherein the conductive skin includes a first surface, wherein at least a portion of the first surface is convex, wherein the conductive skin includes a second surface, and wherein the first surface is joined to the second surface along a first edge;

at least a first nonconductive slot in the conductive skin, wherein the first nonconductive slot extends from the first surface, across the first edge, to the second surface; and a first feed, wherein the first feed includes a conductive member that traverses the first nonconductive slot.

2. The antenna of claim 1, further comprising:

a second feed, wherein the first feed is adjacent a portion of the first nonconductive slot in the first surface, and wherein the second feed is adjacent a portion of the nonconductive slot in the second surface.

3. The antenna of claim 1, further comprising a ground member, wherein the ground member extends between the first surface on a first side of the first edge and the second surface on a second side of the first edge.

4. The antenna of claim 3, further comprising:

a plurality of nonconductive slots;

a plurality of first feeds; and a plurality of second feeds, wherein each nonconductive slot in the plurality of nonconductive slots is associated with one first feed and one second feed.

5. The antenna of claim 4, wherein at least a first set of nonconductive slots in the plurality of nonconductive slots have a first length, and wherein at least a second set of nonconductive slots in the plurality of nonconductive slots have a second length.

6. The antenna of claim 5, wherein the nonconductive slots in the first set of nonconductive slots are longer than the nonconductive slots in the second set of slots, and wherein the nonconductive slots in the first set of nonconductive slots are interleaved with the nonconductive slots in the second set of nonconductive slots.

7. The antenna of claim 6, wherein more than one of the second nonconductive slots are placed between adjacent nonconductive slots in the first set of nonconductive slots.

8. The antenna of claim 4, further comprising:

at least first and second of rib members, wherein the first and second rib members in combination with at least a portion of the conductive skin and at least a portion of the conductive ground member define a first volume, and wherein at least one first nonconductive slot and at least one second nonconductive slot are formed in an area of the conductive skin that is between the first and second rib members.

9. The antenna of claim 4, wherein each of the feeds includes a coaxial conductor, with a center conductor that traverses an associated nonconductive slot and is electrically connected to the conductive skin on a far side of the associated nonconductive slot, and with a shield conductor that is electrically connected to the conductive skin on a near side of the associated nonconductive slot.

10. The antenna of claim 4, wherein each of the feeds includes a feed line that traverses an associated nonconductive slot.

11. The antenna of claim 10, wherein each of the feeds is a trace formed on a circuit board, and where-in the feed is grounded to the conductive skin on a far side of the associated nonconductive slot.

12. The antenna of claim 10, wherein each of the feeds is a trace with a flared end formed on a circuit board, and wherein each of the feeds is electrically isolated from the conductive skin.

13. The antenna of claim 1, wherein the first nonconductive slot is formed in a conductive layer of the conductive skin, and wherein a nonconductive layer forms an outer surface of the structure.

14. The antenna of claim 1, wherein at least a portion of the second surface is convex.

15. An integrated antenna system, comprising:

a structure, including:

a first conductive skin portion;

a second conductive skin portion, wherein the first and second conductive skin portions are joined along a first edge;

a plurality of nonconductive slots, wherein each of the nonconductive slots extends continuously from a first point in the first conductive skin portion, across the first edge, to a second point in the second conductive skin portion; and a plurality of feeds, wherein each nonconductive slot in the plurality of nonconductive slots is associated with a first feed that traverses a portion of the nonconductive slot formed in the first conductive skin portion and with a second feed that traverses a portion of the nonconductive slot formed in the second conductive skin portion.

16. The integrated antenna system of claim 15, wherein the plurality of nonconductive slots includes a plurality of first nonconductive slots having a first length and a plurality of second nonconductive slots having a second length.

17. The integrated antenna system of claim 16, wherein at least two of the second nonconductive slots are interposed between each adjacent pair of first nonconductive slots.

18. The integrated antenna system of claim 17, further comprising:

a conductive spar, wherein the conductive spar extends between the first conductive skin portion and the second conductive skin portion; and a plurality of conductive ribs, wherein a first conductive rib extends from the first edge to the conductive spar, wherein a second conductive rib extends from the first edge to the conductive spar, wherein the first and second conductive ribs, the conductive spar, and inner surfaces of the first and second conductive skin portions define a volume, wherein the volume is associated with a plurality of the first nonconductive slots and a plurality of the second nonconductive slots, and wherein the first edge is a leading edge of an aerodynamic structure.

19. The integrated antenna system of claim 15, wherein the conductive skin portions are formed from composite materials having at least a first conductive layer, and wherein the nonconductive slots are formed in the first conductive layer.

20. A method of forming a structure having an integrated antenna, comprising:

forming a plurality of nonconductive slots in a conductive skin of the structure having first and second surfaces joined along an edge, wherein each of the nonconductive slots extends across the edge and includes a first portion formed in the first surface and second portion formed in the second surface;

for each of the nonconductive slots, forming a first feed point at the first portion of the respective nonconductive slot; and for each of the nonconductive slots, forming a second feed point at the second portion of the respective nonconductive slot.

* * * * *